US005228981A

United States Patent [19]

Olmstead et al.

[11] Patent Number: 5,228,981

[45] Date of Patent: Jul. 20, 1993

[54] COAL AS AN ADDITIVE TO ACCELERATE THERMAL CRACKING IN COKING

[75] Inventors: William N. Olmstead, Murray Hill, N.J.; Roby Bearden, Jr., Baton Rouge, La.

[73] Assignee: Exxon Research & Engineering Company, Florham Park, N.J.

[21] Appl. No.: 870,165

[22] Filed: Apr. 16, 1992

Related U.S. Application Data

[63] Continuation of Ser. No. 591,337, Oct. 1, 1990, abandoned.

[51] Int. Cl.[5] ..... C10G 9/28; C10G 9/32

[52] U.S. Cl. ..... 208/127; 208/126; 208/153; 208/50

[58] Field of Search ..... 208/127, 126

[56] References Cited

U.S. PATENT DOCUMENTS

| | | | |
|---|---|---|---|
| 2,734,853 | 2/1956 | Smith et al. | 208/127 |
| 3,129,164 | 4/1964 | Cameron | 208/370 |
| 4,014,781 | 3/1977 | Ueda | 208/126 |
| 4,178,227 | 12/1979 | Metrailer et al. | 208/127 |
| 4,200,494 | 4/1980 | Welter et al. | 208/127 |
| 4,204,943 | 5/1980 | Metrailer et al. | 208/127 |
| 4,218,287 | 8/1980 | Albright et al. | 208/127 |
| 4,325,815 | 4/1982 | Metrailer et al. | 208/127 |
| 4,331,529 | 5/1982 | Lambert et al. | 208/127 |
| 4,366,048 | 12/1982 | Metrailer et al. | 208/127 |
| 4,411,768 | 10/1983 | Unger et al. | 208/108 |
| 4,533,463 | 8/1985 | Yan et al. | 208/127 |
| 4,544,479 | 10/1985 | Yan | 208/126 |

*Primary Examiner*—Helane Myers
*Attorney, Agent, or Firm*—Henry E. Naylor

[57] ABSTRACT

A coking process wherein a heavy hydrocarbonaceous chargestock is mixed with a minor amount of coal and preheated to a temperature from about 500° F. up to, but not including, coking temperatures. The pretreated mixture is then reacted in a coking zone at coking conditions.

7 Claims, 1 Drawing Sheet

COAL AS AN ADDITIVE TO ACCELERATE THERMAL CRACKING IN COKING

This is a continuation of U.S. appl. Ser. No. 591,337 filed Oct. 1, 1990 now abandoned.

FIELD OF THE INVENTION

The present invention relates to an improved coking process wherein a heavy hydrocarbonaceous chargestock is mixed with a minor amount of coal and preheated to a temperature from about 500° F. up to, but not including, coking temperatures. The pretreated mixture is then reacted in a coking zone at coking conditions.

BACKGROUND OF THE INVENTION

Much work has been done over the years to convert heavy hydrocarbonaceous materials to more valuable lighter boiling products. Various thermal processes which have resulted from such work include visbreaking, catalytic hydroconversion, in both a slurry and ebullating bed, fluid coking, and delayed coking.

Of particular interest in the practice of the present invention is fluid coking. In fluid coking, a heavy hydrocarbonaceous chargestock, such as a vacuum residuum, is fed to a coking zone comprised of a fluidized bed of hot solid particles, usually coke particles, sometimes also referred to as seed coke. The heavy hydrocarbonaceous material is reacted in the coking zone resulting in conversion products which include a vapor fraction and coke, which is deposited on the surface of the seed particles. A portion of the coked-seed particles is sent to a heating zone which is maintained at a temperature higher than that of the coking zone. Some of the coke is burned off in the heating zone. Hot seed particles from the heating zone are returned to the coking zone as regenerated seed material which serves as the primary heat source for the coking zone. In some fluid coking processes, a portion of hot coke from the heating zone is circulated back and forth to a gasification zone which is maintained at a temperature greater than that of the heating zone. In the gasifier, substantially all of the remaining coke on the seed material is burned, or gasified, off. Examples of U.S. patents which teach fluid coking, with or without an integrated gasification zone, are U.S. Pat. Nos. 3,726,791; 4,203,759; 4,213,848; and 4,269,696; all of which are incorporated herein by reference.

Myriad process modifications have been made over the years in fluid coking in an attempt to achieve higher liquid yields. For example, U.S. Pat. No. 4,378,288 discloses a method for increasing coker distillate yield in a thermal coking process by adding small amounts of a free radical inhibitor.

Also, U.S. Pat. No. 4,642,175 discloses a method for reducing the coking tendency of heavy hydrocarbon feedstocks in a non-hydrogenative catalytic cracking process by treating the feedstock with a free radical-removing catalyst so as to reduce the free radical concentration of the feedstock.

Notwithstanding any advantages the foregoing processes may have, there is a need in the art to be able to operate fluid coking at ever lower temperatures in order to increase the conversion of the feed to more desirable products at the expense of less desirable products such as gas and coke. Unfortunately, as is known in the art, if the temperature of a thermal conversion process is decreased so as to increase the conversion of feed to more desirable products, it is usually necessary to increase the residence time of the feed in the reactor. Increased residence time, in a reactor of constant volume results in lowering of the production rate, which is undesirable. Decreasing the temperature of a thermal conversion process can also have other undesirable effects. For example, in fluid coking, lower temperature conversion can lead gross agglomeration of the fluid bed of coke particles, and the bed of coke particles becomes unstable because of the lower cracking rate of the resid feed. On the other hand, if the temperature of the conversion process is raised, the production rate will increase but at the expense of forming less valuable gaseous products, such as coke and products boiling below 100° F. Thus, there remains a need in the art for increasing the rate of thermal conversion processes without forming less desirable products and preferably increasing both the rate of conversion and the yield of desired products.

SUMMARY OF THE INVENTION

In accordance with the present invention, there is provided an improved coking process for converting a heavy hydrocarbonaceous charge-stock to lighter boiling products which satisfies the above needs. According to the instant process, a heavy hydrocarbonaceous chargestock is pretreated by mixing it with a minor amount of coal, then heating the mixture to a temperature from about 500° F. up to, but not including coking temperatures, for an effective amount of time. The mixture is then reacted in a coking zone at coking conditions.

In one preferred embodiment of the present invention, the coking process is a fluid coking process comprised of:

(a) heating a mixture of a heavy hydrocarbonaceous chargestock and from about 2 to 10 wt. % coal, to a temperature from about 500° F. up to, but not including, the coking temperature of step (b), for an effective amount of time;

(b) reacting the mixture in a coking zone comprised of a bed of fluidized solids maintained at fluid coking conditions, including a temperature from about 850° to 1200° F. and a total pressure of up to about 150 psig, to produce a vapor phase product including normally liquid hydrocarbons, and coke, the coke depositing on the fluidized solids;

(c) introducing a portion of said solids, with coke deposited thereon, into a heating zone comprised of a fluidized bed of solid particles and operated at a temperature greater than said coking zone and in which the fluidizing gas is a mixture of steam and an oxygen-containing gas; and (d) recycling a portion of said heated solids from said heating zone to said coking zone.

In still another preferred process of the present invention, the fluidizing gas in the heater is only steam and a portion of the solids from the heating zone is passed to a gasification zone which is also comprised of a fluidized bed of solid particles and which is maintained at a temperature greater than that of the heating zone and further wherein the fluidizing gas is a mixture of steam and an oxygen-containing gas.

In yet another preferred embodiment of the present invention, about 4 to 8 wt. % of coal is used, based on the total weight of chargestock and coal.

BRIEF DESCRIPTION OF THE DRAWING

The sole FIGURE hereof is a schematic flow plan of a preferred embodiment of the present invention showing a fluid coking process unit comprised of a coking zone, a heating zone, and a gasification zone.

DETAILED DESCRIPTION OF THE INVENTION

Figure 1:
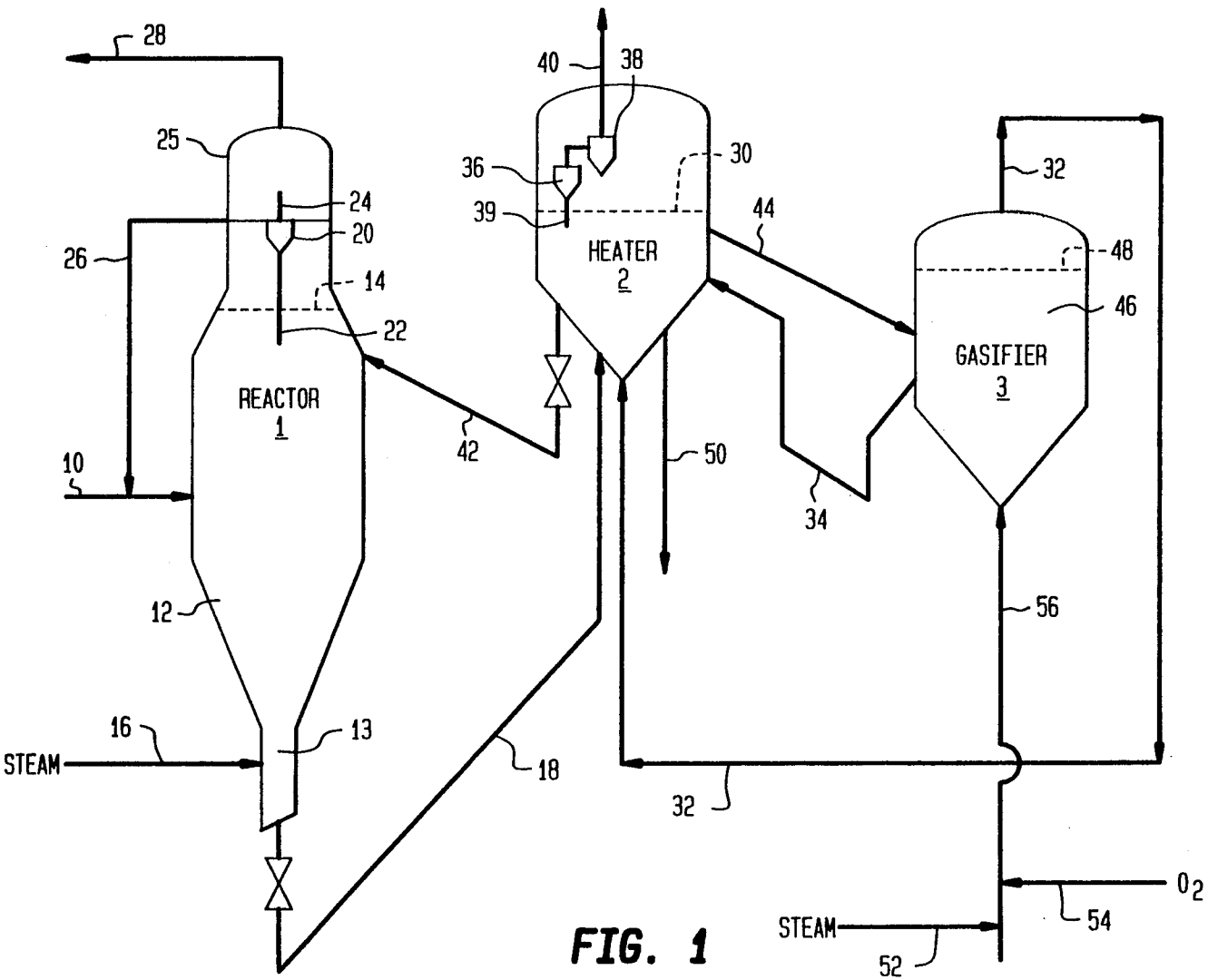

Any heavy hydrocarbonaceous material typically used in a coking process can be used herein. Generally, the heavy hydrocarbonaceous material will have a Conradson carbon residue of about 5 to 40 wt . % and be comprised of moieties, the majority of which boil above about 975° F. Suitable hydrocarbonaceous materials include heavy and reduced petroleum crudes, petroleum atmospheric distillation bottoms, petroleum vacuum distillation bottoms, pitch, asphalt, bitumen, liquid products derived from coal liquefaction processed, including coal liquefaction bottoms, and mixtures thereof.

A typical petroleum chargestock suitable for the practice of the present invention will have composition and properties within the ranges set forth below.

| | |
|---|---|
| Conradson Carbon | 5 to 40 wt. % |
| Sulfur | 1.5 to 8 wt. % |
| Hydrogen | 9 to 11 wt. % |
| Nitrogen | 0.2 to 2 wt. % |
| Carbon | 80 to 86 wt. % |
| Metals | 1 to 2000 wppm |
| Boiling Point | 34° C+ to 650° C.+ |
| Specific Gravity | −10 to 35° API |

Any type of coal, except anthracite, can be used in the practice of the present invention. Non-limiting types of coal include subbituminous coal, bituminous coal, and lignite. Preferred is subbituminous coal. The coal will be present in an effective amount. That is, that minimum amount needed to increase the thermal conversion rate of the chargestock at a given temperature and to conduct that thermal conversion process at a temperature lower than the given temperature to thereby produce more desirable boiling products in lieu of less desirable gaseous products. That is, the coal is added in an amount sufficient to permit conducting the thermal conversion process at lower temperatures than would otherwise be practical. For example, adding a sufficient amount of coal to the heavy hydrocarbonaceous chargestock in an amount sufficient to increase the rate of conversion by about 25% permits operating the coking process about 10° F. lower. This results in a greater yield of liquid product when compared with the same process but without the use of coal in a pretreatment step. The precise amount of coal used, of course, must be determined based upon the particular chargestock employed and the temperature at which the coking zone is operated. As a general guideline however, the amount of coal added to the chargestock will generally be in the range of about 2 to 10 wt. %, preferably from about 4 to about 8 wt. %. based on the total weight of feed and coal.

After mixing the heavy hydrocarbonaceous chargestock with coal, it is important that the mixture be preheated to a temperature from about 500° F. up to, but not including, coking temperatures. Generally, this temperature will be from about 500° F. to 700° F., preferably from for an effective amount of time. That is, for an amount of time which will result in an appreciable increase in conversion rate in the coker when compared with the identical, but without the preheating step. This time period will typically be from about 5 minutes to about 3 hours, preferably from about 30 minutes to about 2 hours. The increase in conversion rate allows for coking at a lower temperature, resulting in reduced secondary vapor phase cracking and higher liquid yield. In a transfer line application, adding the coal will allow either more conversion in the transfer line or operation of the transfer line at lower temperatures. Either of these options would increase the liquid yield at the expense of gas and coke.

With reference now to the FIGURE, which shows an integrated coking/gasification unit where most of the coke is gasified with a mixture of steam and air. The reaction vessel is similar for a fluid coking process than it is for an integrated coking/gasification process. a heavy hydrocarbonaceous/coal mixture is passed by line 10 into coking zone 12 in which is maintained a fluidized bed of solids having an upper level indicated at 14. Although it is preferred that the solids, or seed material, be coke particles, they may also be other refractory materials selected from the group consisting of silica, alumina, zirconia, magnesia, alumdum or mullite, synthetically prepared or naturally occurring material such as pumice, clay, kieselguhr, diatomaceous earth, bauxite, and the like. The solids will have an average particle size of about 40 to 1000 microns, preferably from about 40 to 400 microns.

A fluidizing gas e.g. steam, is admitted at the base of coker reactor 1, through line 16, in an amount sufficient to obtained superficial fluidizing velocity. Such a velocity is typically in the range of about 0.5 to 5 ft/sec. Coke at a temperature above the coking temperature, for example, a temperature from about 100° to 400° F., preferably from about 150° to 350° F., and more preferably about 150° F. to 250° F. in excess of the actual operating temperature of the coking zone is admitted to reactor 1 by line 42 in an amount sufficient to maintain the coking temperature in the range of about 850° to 1200° F. The pressure in the coking zone is maintained in the range of about 0 to 150 psig, preferably in the range of about 5 to 45 psig. The lower portion of the coking reactor serves as a stripping zone to remove occluded hydrocarbons from the coke. A stream of coke is withdrawn from the stripping zone by line 18 and circulated to heater 2. Conversion products are passed through cyclone 20 to remove entrained solids which re returned to coking zone through dipleg 22. The vapors leave the cyclone through line 24, and pass into a scrubber 25 mounted on the coking reactor. If desired, a stream of heavy materials condensed in the scrubber may be recycled to the coking reactor via line 26. The coker conversion products are removed from the scrubber 25 via line 28 for fractionation in a conventional manner.

In heater 2, stripped coke from coking reactor 1 (cold coke) is introduced by line 18 to a fluid bed of hot coke having an upper level indicated at 30. The bed is partially heated by passing a fuel gas into the heater by line 32. Supplementary heat is supplied to the heater by coke circulating from gasifier 3 through line 34. The gaseous effluent of the heater, including entrained solids, passes through a cyclone which may be a first cyclone 36 and a second cyclone 38 wherein the separation of the larger entrained solids occur. The separated larger solids are returned to the heater bed via the respective cyclone diplegs. The heated gaseous effluent which contains entrained solids is removed from heater 2 via line 40.

Hot coke is removed from the fluidized bed in heater 2 and recycled to coking reactor by line 42 to supply heat thereto. Another portion of coke is removed from heater 2 and passed by line 44 to a gasification zone 46 in gasifier 3 in which is maintained a bed of fluidized coke having a level indicated at 48. If desired, a purged stream of coke may be removed from heater 2 by line 50.

The gasification zone is maintained at a temperature ranging from about 1600° to 2000° F. at a pressure ranging from about 0 to 150 psig, preferably at a pressure ranging from about 25 to about 45 psig. Steam by line 52, and a molecular oxygen-containing gas, such as air, commercial oxygen, or air enriched with oxygen by line 54 pass via line 56 into gasifier 3. The reaction of the coke particles in the gasification zone with the steam and the oxygen-containing gas produces a hydrogen and carbon monoxide-containing fuel gas. The gasified product gas, which may further contain some entrained solids, is removed overhead from gasifier 3 by line 32 and introduced into heater 2 to provide a portion of the required heat as previously described.

While the above process has been described in connection with a fluid coking process, especially integrated with a gasification zone, it may also be practiced in a delayed coking process. Typically in delayed coking, a heavy hydrocarbonaceous chargestock is charged into a vacuum distillation tower to obtain a boiling point cut at about 900° to 1050° F. The residue is sent to a furnace and heated to a temperature of about 800° to 950° F. It is then sent to a coking drum and coked for a period of several hours. The coking drum is operated at a temperature of about 800° to 925° F. for further cracking. Other suitable processes include visbreaking wherein a heavy hydrocarbonaceous feedstock is treated at more mild conditions then coking. Generally, visbreaking process conditions include a temperature from about 700° to 900° F., and pressures ranging from about 500 to 1300 psig and at relatively short residence times of about 1 to 5 minutes.

Having thus described the present invention, and a preferred and most preferred embodiment thereof, it is believed that the same will become even more apparent by reference to the following examples. It will be appreciated, however, that the examples, as well as the figures hereof, are presented for illustrated purposes and should not be construed as limiting the invention.

COMPARATIVE EXAMPLES 1 and 2 and EXAMPLES 1–4

The coal for these examples was a subbituminous coal from Wyoming. The coal was mixed with Arab Heavy vacuum resid. The distillation cut point for the resid was about 975° F., corrected to atmospheric pressure, for Comparative Example 1 and Examples 1 to 3. The cut point for resid was about 1290° F., corrected to atmospheric pressure, for Comparative Example 2 and Example 4. For the cases where there was a pretreatment, the mixture of coal and resid was heated in a stirred autoclave to the temperature and held there for the time indicated in Table I below. The autoclave was cooled and the mixture removed and treated at coking temperatures as set out below.

The mixtures were first heated to about 625°, held at that temperature for less than a minute, and quickly heated to 950° F. in about 5 seconds. The weight loss was recorded as a function of time until there were no observable further weight loss. At this point, the weight loss was measured and defined as the total weight loss. In order to calculate the first order rate constant, the fraction of reactant remaining was calculated at several times. This fraction of reactant remaining is the total weight loss minus the weight loss at a given time, divided by the total weight loss. As described in most physical chemistry tests (e.g., G. W. Castellan, *Physical Chemistry*, 2nd ed., Addison Wesley, 1971, p.736), the rate constant is the slope of a plot of the natural logarithm of the fraction of reactant remaining vs. time. The ratio of the rate constants relative to the corresponding Comparative Example are shown in Table I below.

TABLE I

| Example | Coal, Wt. % of Mixture | Pretreatment Temperature, °F. | Pretreatment Time, Min. | $k/k_o$ |
|---|---|---|---|---|
| Comparative Example 1 | 0 | None | None | 1.00 |
| 1 | 10 | 399 | 90 | 0.85 |
| 2 | 10 | 540 | 90 | 1.22 |
| 3 | 10 | 700 | 30 | 1.09 |
| Comparative Example 2 | 0 | None | None | 1.00 |
| 4 | 10 | None | None | 0.99 |

COMPARATIVE EXAMPLES 3 TO 4 AND EXAMPLES 5 to 6

Subbituminous coal from Alberta, Canada was used for these examples. The distillation cut point for the resid was about 975° F., corrected to atmospheric pressure, for Comparative Example 3 and Example 5. The cut point for the resid for Comparative Example 4 and Example 6 was about 1290° F., corrected to atmospheric pressure. For these examples there was a pretreatment wherein the mixture of coal and resid was heated in a stirred autoclave to the temperature and held at that temperature for that period of time indicated in Table II below. The autoclave was cooled and the mixture was removed and treated at coking temperatures as set forth in the above examples.

TABLE II

| Example | Coal, Wt. % of Mixture | Pretreatment Temperature, °F. | Pretreatment Time, Min. | $k/k_o$ |
|---|---|---|---|---|
| Comparative Example 3 | 0 | None | None | 1.00 |
| 4 | 10 | 540 | 90 | 1.22 |
| Comparative Example 4 | 0 | None | None | 1.00 |
| 5 | 10 | None | None | 1.04 |

What is claimed is:

1. A process for converting heavy hydrocarbonaceous feedstocks to lower boiling products, which process comprises:

(a) forming a mixture of the hydrocarbonaceous feedstock and up to about 10 wt. % coal, based on the total weight of feedstock and coal, (b) heating the mixture to a temperature from about 500° F. to about 700° F. from 30 minutes to 2 hours;

(c) passing the mixture to a coking zone comprised of a bed of fluidized solids maintained at fluid coking conditions, including temperatures from about 850° F. to 1200° F., thereby producing a vapor phase product including normally liquid hydrocarbons, and coke, said coke depositing on the fluidized solids;

(d) introducing a portion of said solids, with coke deposited thereon, into a heating zone comprised of a fluidized bed of solid particles and operated at a temperature greater than said coking zone, and in which the fluidizing gas is a mixture of steam and an oxygen-containing gas; and (e) recycling a portion of said heated solids from said heating zone to said coking zone.

2. The process of claim 1 wherein the amount of coal ranges from about 4 to 8 wt. %.

3. The process of claim 1 wherein the heating zone is maintained at a temperature which is about 100° to 400° F. greater than the coking zone.

4. The process of claim 3 wherein the heating zone is maintained at a temperature which is about 150° to 250° F. greater than the coking zone.

5. The process of claim 1 wherein the fluidizing gas of the heating zone is steam only and a portion of the solids from the heating zone is passed to a gasification zone comprising a fluidized bed of solid particles which is maintained at a temperature greater than the heating zone and wherein the fluidizing gas is a mixture of steam and an oxygen-containing gas, and wherein a portion of the gasified solid particles is recycled to the heating zone.

6. The process of claim 5 in which the gasification zone is maintained at a temperature of about 1600° to 2000° F.

7. The process of claim 5 wherein the heating zone is maintained at a temperature which is about 100° to 400° F. higher than that of the coking zone and from about 4 to 8 wt. % coal is used.

* * * * *